United States Patent [19]

Jorgensen et al.

[11] Patent Number: 4,566,371

[45] Date of Patent: Jan. 28, 1986

[54] VARIABLE PNEUMATIC PRESSURE FORCE-TRANSMITTING MECHANISM

[75] Inventors: Ray B. Jorgensen; Robert T. Ackerman, both of Seattle, Wash.

[73] Assignee: Nicholson Manufacturing Company, Seattle, Wash.

[21] Appl. No.: 444,955

[22] Filed: Nov. 29, 1982

[51] Int. Cl.[4] ..... F01B 19/04; B27L 1/00

[52] U.S. Cl. ..... 92/92; 92/90; 92/165 R; 92/167; 144/208 E

[58] Field of Search ..... 92/92, 91, 90, 89, 165 R, 92/167; 144/208 E

[56] References Cited

U.S. PATENT DOCUMENTS

| | | | |
|---|---|---|---|
| 2,829,500 | 4/1958 | Butler | 92/92 |
| 2,927,431 | 3/1960 | Pitts | 92/92 |
| 3,137,329 | 6/1964 | Smith | 144/208 |
| 3,190,327 | 6/1965 | Robbins | 144/208 |
| 3,361,168 | 1/1968 | Brown | 144/208 E |
| 3,624,802 | 11/1971 | Ripert | 92/167 |
| 3,770,030 | 11/1973 | Palfy | 144/208 E |
| 4,403,538 | 9/1983 | Rise | 92/167 |
| 4,502,673 | 3/1985 | Clark | 267/64.24 |

*Primary Examiner*—Robert E. Garrett
*Assistant Examiner*—Richard S. Meyer
*Attorney, Agent, or Firm*—Robert W. Beach; Ward Brown

[57] ABSTRACT

Attitude control mechanism for a flexible bag component of a composite pneumatic chamber including a fixed section over which an inturned portion of a flexible bag pneumatic chamber section rolls includes a cantilever bag attitude control stem having its root anchored in a mounting closing the end of the flexible bag remote from the rigid pneumatic chamber section and extends through a central guide aperture of at least one frame mounted within the rigid pneumatic chamber section for substantially linear reciprocation guidance so as to prevent appreciable buckling of the flexible bag as it is contracted axially by movement of the mounting carrying the stem toward the rigid pneumatic chamber section.

4 Claims, 6 Drawing Figures

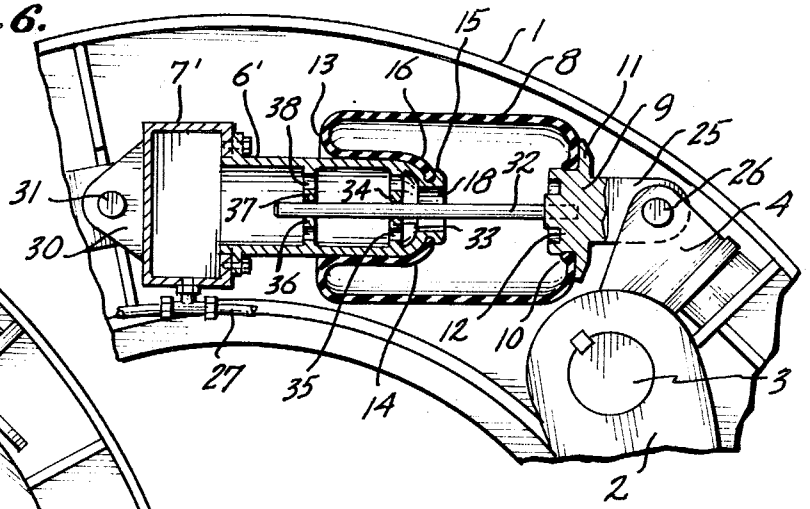
Fig. 6.
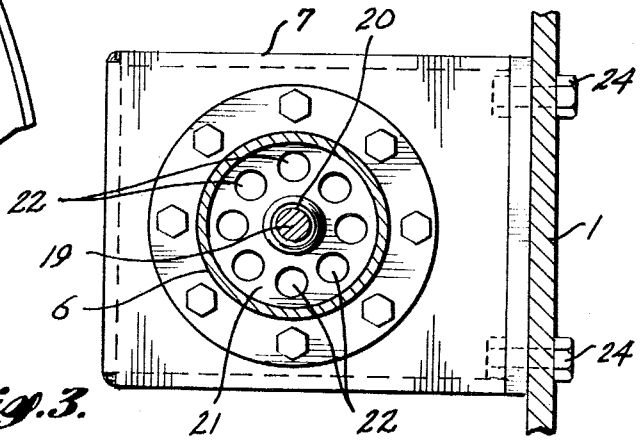
Fig. 3.
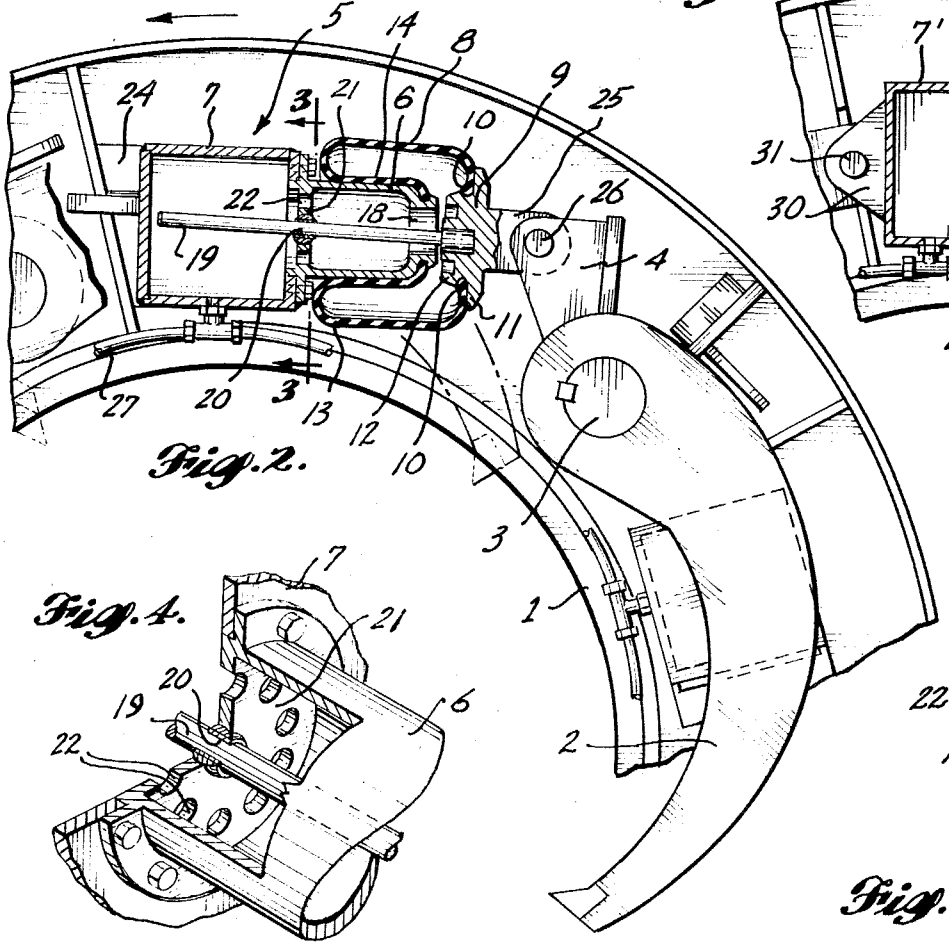
Fig. 2.
Fig. 4.

VARIABLE PNEUMATIC PRESSURE FORCE-TRANSMITTING MECHANISM

BACKGROUND OF THE INVENTION

1. Field of the Invention

The present invention relates to variable pneumatic pressure force-transmitting mechanism which includes a flexible pneumatic chamber that is contractable and extensible and that can be contracted without appreciable buckling.

2. Prior Art

The pneumatic pressure mechanism of the present invention is particularly suited for exerting pressure on the barking arms of a mechanical log barker of the type shown in Robbins U.S. Pat. No. 3,190,327 or Smith U.S. Pat. No. 3,137,329 for example.

Each of the pneumatic actuators for a barking arm of the Robbins patent log barker includes a sectorshaped pneumatic chamber through which swings a rectangular vane that is connected to the barking arm. It is difficult to seal the edges of such vanes relative to the walls of the pneumatic chamber.

The barking arm actuators of the Smith patent include pneumatic chambers in the form of hoses that bear on shoes connected to the barker arms, but such pneumatic chambers are capable of only very limited change in volume for moving such shoes and the hoses undoubtedly would be subject to quite rapid fatigue.

Flexible pneumatic chambers of generally circular cross section which can be contracted and extended have been used for various purposes but they have not been suitable for use under conditions where they would be susceptible to excessive buckling during contraction because the resultant repeated deformation during use would cause rapid fatigue.

SUMMARY OF THE INVENTION

It is a principal object of the present invention to provide mechanism for controlling or minimizing buckling of a flexible pneumatic chamber during contraction where one end of the chamber moves nonlinearly and transmits mechanical force.

A further object is to provide such control mechanism which is effective while being compact and of simple construction.

The foregoing objects can be accomplished by providing a cooperating guide stem carried by a force-transmitting head of a flexible chamber in which the stem extends generally axially through the flexible chamber and bridges between its ends and is reciprocable through a guide aperture so as to permit limited relative tilting of the flexible chamber head while preventing appreciable relative tilting of the chamber ends which would effect buckling of the flexible chamber.

BRIEF DESCRIPTION OF THE DRAWINGS

FIG. 2 is a transverse section similar to FIG. 1 but showing parts in different positions.

FIG. 3 is a transverse section through the mechanism taken on line 3—3 of FIG. 1.

FIG. 4 is a detail perspective of a portion of the mechanism.

FIG. 6 is a transverse section through a portion of a barker ring similar to FIG. 1 but showing a further modified type of construction.

DETAILED DESCRIPTION

Figures 1, 5:
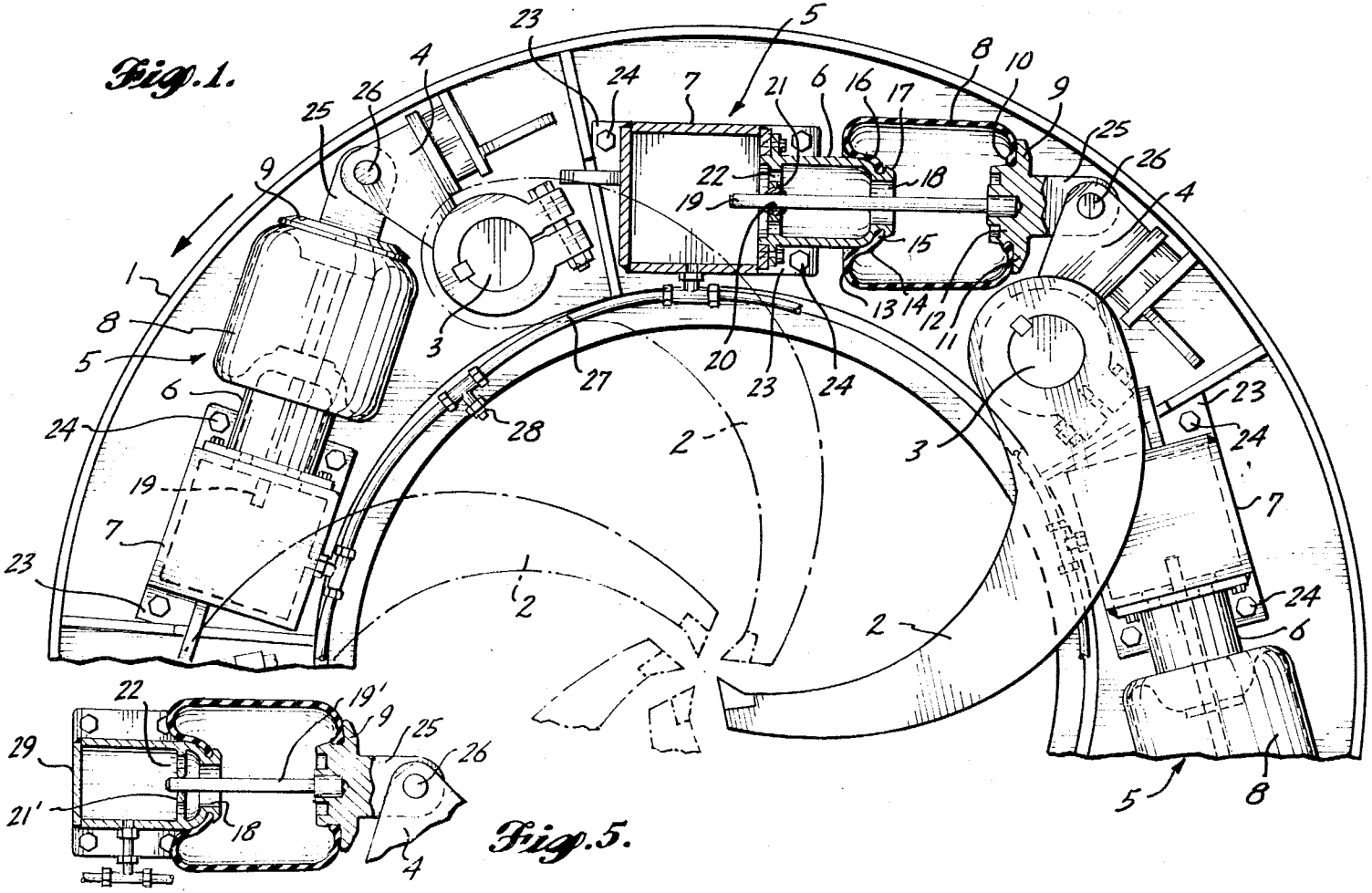
FIG. 1 is a transverse section through a log barker showing an installation of pneumatic chambers according to the present invention, parts being broken away.
FIG. 5 is a fragmentary transverse section through a portion of a barker ring similar to FIG. 1 but showing a modified type of construction.

The variable pneumatic pressure force-transmitting mechanism of the present invention is illustrated as being employed as pressers for barking arms in a mechanical ring type of log barker. Such a barker includes a ring 1 through which logs are transported lengthwise while the ring rotates relative to them to drag the inner ends of barking arms 2 spirally around the log to scrape bark from the log. In order to provide an effective bark removal operation, the barking ends of arms 2 must be pressed with considerable force against the log. Pressers of the present invention are utilized to apply force to the barking arms for producing such barking pressure and to receive force from the barking arms when they are swung outward by contact with a log.

The outer end of each barking arm 2 is mounted on an axle 3 which supports the arm for inward and outward swinging of its inner end to a degree conforming to the size of a log being barked. Each barking arm is biased to swing its inner barking end inward about the center of axle 3 by pressure exerted on a force-transmitting lever arm 4 projecting generally outward from the outer end of the barking arm, which lever arem also swings about the center of axle 3. The variable pneumatic pressure mechanism of the present invention exerts a force on such lever arm to effect such swinging.

The variable pneumatic presser 5 includes a composite pneumatic pressure chamber including a rigid pressure chamber section 6 which may have an auxiliary rigid reservoir 7 and a contractable and extensible section 8, which sections are always in communication with each other. In the form of mechanism shown, the contractable and extensible section of the pneumatic chamber is a flexible air bag which is connected between the rigid pneumatic chamber section 6 and a head 9.

The flexible air bag 8 is generally cylindrical, being of circular cross section, and having central apertures in its opposite ends. The aperture in one of such ends has an annular bead 10 that will bear tightly in sealing engagement against the shoulder formed by the annular flange 11 on head 9 which encircles a central boss 12 so that such head forms one end of the contractable and extensible section. The other end 13 of the bag is recurved to provide an inturned end portion 14 of smaller diameter than the central portion of the bag and having an annular bead 15 encircling its aperture. Such bead will fit tightly in sealing engagement against a shoulder 16 formed on the adjacent end of the rigid pneumatic chamber section 6 by an axial flange 17 projecting from such chamber end. The axial opening 18 within such axial flange affords communication between the interior of the rigid pneumatic chamber section 16 and the contractable and extensible chamber section 8.

The axial opening 18 further provides a passage for an axial cantilever stem 19 of bag attitude control means, the roat of which is anchored in the inner side of head 9 so that such stem bridges across the flexible chamber section 8 between such head and the rigid chamber section 6. The free end portion of such stem extends through a guide aperture 20 in the central portion of a transverse frame 21 spanning the interior of the rigid pneumatic chamber section 6. Such frame has ports 22 extending through it between its central aperture 20 and the wall of the rigid chamber section so as to afford substantially unobstructed interchange of air between the portions of the rigid pneumatic chamber section on opposite sides of such frame. The control stem 19 is located completely within the composite pneumatic chamber, and consequently does not pierce the wall of the composite chamber, thus avoiding the necessity of any packing joints around the stem.

The pneumatic presser mechanism 5 of the type shown in FIGS. 1, 2 and 3 can be installed within the barker ring 1 by attaching ears 23 formed on the auxiliary rigid pneumatic pressure chamber reservoir 7 to the barker ring by bolts or machine screws 24. The other end of the pneumatic chamber formed by the head 9 is attached to the lever arm 4 of a barking arm 2 by connecting a lug 25 projecting from the head to such lever arm by a pivot pin 26, so that such pivot pin and the lug 25 are guided to move nonlinearly by the nonlinear swinging of lever arm 4 about the center of axle 3. The pivot 26 connection can transmit force between the barking arm 2 and the presser mechanism 5 in either direction.

It is preferred that all of the rigid pneumatic chamber sections in the barker ring be interconnected by a conduit 27, although such interconnection is not necessary. An initial pressure may be established in all of the pneumatic chambers equally by supplying air under pressure to the fitting 28 of such conduit. Instead of interconnecting the pressure chambers, each pressure chamber can be precharged with air separately, but such interconnection is preferred to ensure initial equalization of pressure in the several chambers and to ensure continued equalization of pressure if a log is not precisely centered within the ring 1 or if the log has irregularities on it which may effect somewhat unequal swinging of the barking arms relative to the barker ring.

Prior to transporting a log through the barker ring, the initial pressure in the pneumatic chambers of the pressers will extend the flexible bags 8 to their maximum central axial extent for exerting force on the lever arms 4 to swing the barking arms inward to the positions illustrated in FIG. 1. If the barker ring 1 is turning in the counterclockwise direction indicated in FIG. 1 as a log is advanced lengthwise into the ring aperture, the sharpened edges of the barking arms 2 will contact the log end and the rotation of the ring will cause the inner ends of the barking arms to swing outward in a self-opening operation until the inner ends of the arms engage the periphery of the log. Such outward swinging of the barking arms will effect swinging of the lever arms 4 in a direction to exert force on the pivots 26, lugs 25 and heads 9 to contract the pressers 5 generally axially.

As shown in FIGS. 1 and 2, the transverse size of the rigid pneumatic chamber section 6 is sufficiently smaller than the cross-sectional size of the larger central portion of the flexible bag 8 that, when the central axial extent of the flexible bag is contracted from the condition of FIG. 1 toward the condition of FIG. 2, the inturned end portion 14 of the flexible bag will roll over the exterior of the rigid pneumatic chamber section 6 to increase the axial extent of the inturned bag portion 14, shift the axial position of the return bent bag portion 13 and decrease the axial extent of the outer portion of the bag. The size of the rigid pneumatic chamber section 6 should be sufficiently smaller than the size of the larger cross-sectional portion of the flexible bag so that the reverted portion of the flexible bag will be curved easily to reduce a stress concentration area that would contribute greatly to the fatigue of the flexible material such as rubber or synthetic rubber.

While it is evident from the overlapping relationship of the inturned portion 14 of the bag 8 and the rigid section 6 of the pneumatic chamber that such rigid section serves to a considerable extent as a guide for the inturned portion of the bag 8, if there were no other provision for controlling the attitude of the bag during contraction under the axial compressive force resulting from outward swinging of the barking arms 2, the head 9 could tilt uncontrolled relative to the stationarily mounted rigid section 6 of the pneumatic chamber and guide aperture 6 to buckle the flexible bag, resulting in crimping of the shorter side of the bag. Such unbalanced stressing of the bag would promote early failure and is unacceptable from a maintenance viewpoint.

To obviate the disadvantages of prior art structures providing either for uncontrolled contraction of flexible bags, or providing bag attitude control mechanism which was ineffective or impractical, the present invention provides bag attitude control means utilizing the cooperation of the cantilever stem 19 with the guide aperture 20 through which it extends to control the attitude of the flexible bag 8 so that its walls are subjected to substantially uniform conditions and stresses throughout its contraction movement despite the nonlinear movement of the pivot pin 26. Because the pivot pin will travel in an arcuate path about the center of the barking arm axle 3 as the arm swings, the lug 25 and head 9 cannot be restricted to linear reciprocation if the rigid chamber section 6 is fixed to the barker ring 1. The bag attitude control means allows the lug and head to be tilted to a small extent relative to the rigid chamber section 6 during contraction of the bag 8 from the condition shown in FIG. 1 to that of FIG. 5. Movement of the lug pivot 26 laterally of rod 19 will cause slight angular movement or tilting of the stem 19 generally about the center of the guide aperture 20 through which the stem extends. To accommodate such slight tilting of the stem, the aperture 20 can be made somewhat larger than the portion of the stem that reciprocates through it because the aperture is not required to seal around the stem. For example, the stem can have a diameter of 's of an inch (2.2 cm) while the aperture 20 may have a diameter of 15/16's of an inch (2.4 cm).

Alternatively, instead of the guide aperture 20 being a straight bore, it may flare toward the root of the stem and be tapered toward the tip of the stem, which would reduce the lateral play of the stem in such aperture. In either case, despite the loose fit of the stem 19 in the aperture 20, the cooperation of such stem and aperture will control the reciprocating movement of the head 9 relative to the rigid section 6 of the pneumatic chamber so as to limit tilting of the head relative to the rigid chamber to a small amount and, consequently, such cooperation will hold the flexible bag 8 in condition of substantially uniform rolling of its inturned portion on the exterior of the rigid chamber section 6 as the flexible bag contracts from the position from FIG. 1 to the position of FIG. 2.

Depending upon the pressure that it is desired to have the inner ends of the arms 2 exert on a log, the initial or precharged pressure of the pneumatic system, or of each individual presser, may be from 25 pounds to 100 pounds. As the barking arms are swung outward by contact with a log from the position shown in FIG. 1 toward the position shown in FIG. 2, contraction of each flexible bag 8 will reduce the volume of the pneumatic chamber and increase the pressure in it. Depending on the total maximum volume of the pneumatic chamber in each presser and the volume of conduit 27 connecting the presser chambers, and also depending on the proportion of the volume of the system represented by the flexible bags 8, the pressure in the system may be increased from the initial pressure range of 25 pounds to 100 pounds to a maximum pressure range of 50 pounds to 160 pounds. The collective volume of the flexible bags 8 may be from 20 percent to 80 percent of the total volume of the pneumatic system.

If it is desired to have a greater pressure increase in the system for a given contraction of a flexible bag 8, the conduit 27 interconnecting the pneumatic chambers of the several pressers can be omitted, or individual valves may be provided at each pressure chamber connection that can be closed to effectively remove the conduit 27 from the system after precharging of the pneumatic chambers has been accomplished.

Also, the degree of pressure increase effected by contraction of the bags 8 can be augmented by increasing the volumetric proportion of each flexible bag 8 relative to the combined volume of such flexible bag and the associated rigid pneumatic chamber 7. The length of the rigid chamber relative to the flexible bag must, however, be great enough so that the rigid chamber will accommodate the stem 19 throughout its lengthwise stroke correspondign to full movement of the flexible bag head 9 between maximum and minimum volumes f the flexible bag. Such objective can be accomplished by the construction shown in FIG. 5 in which the auxiliary rigid pressure chamber section 7 has been deleted in favor of an end wall 29 on which the rigid pneumatic chamber section 6 is mounted. Because of the more limited space afforded for movement of the stem, the stem 19' of FIG. 5 is shorter than the stem 19 of FIGS. 1 and 2 and the guide aperture frame 21 has been moved away from the end plate 29 to a position close to the opposite end wall of the rigid pneumatic chamber section. Except for the greater pressure build-up that will be accomplished in the pneumatic chamber for a given degree of swinging of a barking arm 2 and its lever arm 4, the operation of the presser and its bag attitude control mechanism shown in FIG. 5 will be similar to the operation of the mechanism shown in FIGS. 1 and 2, as described in detail above.

The mechanism shown in FIG. 6 provides attitude control for the flexible bag 8 during its contraction movement effected by outward swinging of the barking arm 2 and consequent swinging of the lever arm 4 even though the rigid pneumatic chamber section 6' and the auxiliary rigid reservoir 7' are not fixedly mounted to the barker ring 1. In this instance, the rigid pneumatic chamber portions 6' and 7' are capable of swinging relative to the lever arm 4 because they are attached to the barker ring by a lug 30 projecting from the auxiliary reservoir 7' connected by pivot pin 31 to the barker ring. Buckling of the flexible pneumatic chamber section 8 in this instance is eliminated by the cantilever stem 32 having its root anchored in head 9 and projecting axially through apertures in two frames 33 and 36 spaced apart lengthwise of such stem and of the rigid pneumatic chamber section 6'. One of these frames 33 is located close to the opening 18 in the end of the rigid pneumatic chamber section nearer head 9. Such frame has a guide aperture 34 in its central portion and pressure-equalizing apertures 35 arranged around such guide aperture. Spaced from the frame 33 a distance lengthwise of stem 32 sufficient to provide stability for the stem guidance is a second frame 36 having in it a central guide aperture 37 through which the stem 32 extends and pressure-equalizing apertures 38 located between the guide aperture and the wall of the rigid pneumatic chamber section 6'.

The aligned stem guide apertures 34 and 37 of the frames 33 and 36, respectively, will guide the stem 32 for precisely linear reciprocation relative to the rigid chamber section 6' irrespective of swinging movement of the presser about its pivot 31 effected by the throw of the lever arm 4. To minimize tilting of the stem 32 relative to frames 33 and 36 and the rigid pneumatic chamber 6', the guide apertures 34 and 37 may be of a size to fit the stem 32 with snug sliding fits.

While the control mechanism for the pressers shown in FIGS. 1 and 5 have been described as utilizing a stem extending through a guide aperture having substantial clearance, such aperture could fit the stem closely and be provided in a self-aligning bearing or a spherical bearing mounted in the apertured frame as shown in FIG. 1.

Moreover, while the flexible bag attitude control force-transmitting mechanism of the present invention has been described in connection with a presser utilized for transmitting force between a log barker ring and barking arm carried by such ring, such control mechanism could be used for the flexible bag of a presser or a resister utilized for other purposes.

We claim:

1. Variable pneumatic pressure force-transmitting mechanism comprising a force-transmitting member, pivot means mounting said force-transmitting member for arcuate movement, a closed composite pneumatic chamber including a reciprocable head pivotally connected to said force-transmitting member, a rigid pneumatic chamber section remote from said reciprocable head and a contractable and extensible pneumatic chamber section connected between said rigid pneumatic chamber section and said reciprocable head in communication with said rigid pneumatic chamber section, and attitude control means including a cantilever stem carried by said head, housed entirely within said closed composite pneumatic chamber, which does not pierce the wall of said closed composite pneumatic chamber, said stem extending through the interior of said contractable and extensible pneumatic chamber section from said reciprocable head into said rigid pneumatic chamber section and guiding said reciprocable head for limiting tilting relative to said rigid pneumatic chamber section as the spacing between said reciprocable head and said rigid pneumatic chamber section decreases during contraction of said contractable and extensible pneumatic chamber section and arcuate movement of said force-transmitting member about said pivot means.

2. The mechanism defined in claim 1, in which the attitude control means includes a frame carried by the rigid pneumatic chamber section having a guide aperture therethrough, the cantilever stem projecting through said guide aperture from the contractable and extensible pneumatic chamber section into the rigid pneumatic chamber section and tiltable in said guide aperture relative to said frame as the reciprocable head tiles relative to said frame and the rigid pneumatic chamber section.

3. Variable pneumatic pressure force-transmitting mechanism comprising a force-transmitting member, pivot means mounting said force-transmitting member for arcuate movement, a closed composite pneumatic chamber including a reciprocable head pivotally connected to said force-transmitting member, a rigid pneumatic chamber section of substantially circular cross section remote from said reciprocable head and a contractable and extensible pneumatic chamber section connected between said rigid pneumatic chamber section and said reciprocable head, in communication with said rigid pneumatic chamber section and including a flexible bag with a larger portion of substantially circular cross section substantially larger than the cross section of said rigid pneumatic chamber section, having one end attached to and closed by said head and having an inturned portion closely overlapping said rigid pneumatic chamber section and joined to said larger portion of said flexible bag by a return bent bag portion, and attitude control means including a cantilever stem carried by said head, housed entirely within said closed composite pneumatic chamber, which does not pierce the wall of said closed composite pneumatic chamber, said stem extending through the interior of said contactable and extensible pneumatic chamber section from said reciprocable head into said rigid pneumatic chamber section and guiding said reciprocable head for limited tilting relative to said rigid pneumatic chamber section as the spacing between said reciprocable head and said rigid pneumatic chamber section decreases during contraction of said contractable and extensible pneumatic chamber section and arcuate movement of said force-transmitting member about said pivot means, said attitude control means including a frame carried by said rigid pneumatic chamber section having a guide aperture therethrough and a cantilever stem carried by said reciprocable head, housed entirely within said closed composite pneumatic chamber, projecting through said guide aperture from said contractable and extensible pneumatic chamber section into said rigid pneumatic chamber section and tiltable in said guide aperture relative to said frame as sald reciprocable head tilts relative to said frame and sald rigid pneumatic chamher section.

4. Variable pneumatic pneumatic pressure force-transmitting mechanism comprising a force-transmitting member, pivot means mounting said force-transmitting member for arcuate movement, a closed composite pneumatic chamber including a reciprocable head pivotally connected to said force-transmitting member, a rigid pneumatic chamber section of substantially circular cross section remote from said head and a contractable and extensible pneumatic chamber section connected between said rigid pneumatic chamber section and said reciprocable head, in communication with said rigid pneumatic chamber section and including a flexible bag with a larger portion of substantially circular cross section substantially larger than the cross section of said rigid pneumatic chamber section, having one end attached to and closed by said reciprocable head and having an inturned portion closely overlapping said rigid pneumatic chamber section and joined to said larger portion of said flexible bag by a return bent bag portion, and attitude control means including a cantilever stem carried by said reciprocable head, housed entirely within said closed composite pneumatic chamber, which does not pierce the wall of said closed composite pneumatic chamber, said stem extending through the interior of said contractable and extensible pneumatic chamber section from said reciprocable head into said rigid pneumatic chamber section and guiding said reciprocable head relative to said rigid pneumatic chamber section as the spacing between said reciprocable head and said rigid pneumatic chamber section decreases during contraction of said contractable and extensible pneumatic chamber section and arcuate movement of said force-transmitting member about said pivot means, and two frames in said rigid pneumatic chamber section spaced a substantial distance lengthwise of said ste, each of said frames having in it a guide aperture through which said stem extends from said contractable and extensible pneumatic chamber section into said rigid pneumatic chamber section, and pivot means mounting said rigid pneumatic chamber section for swinging relative to said force-transmitting member.

* * * * *

UNITED STATES PATENT AND TRADEMARK OFFICE

CERTIFICATE OF CORRECTION

PATENT NO. : 4,566,371

DATED : January 28, 1986

INVENTOR(S) : Ray B. Jorgensen; Robert T. Ackerman

It is certified that error appears in the above-identified patent and that said Letters Patent are hereby corrected as shown below:

Column 7, line 44, delete "saId" and insert ...said...;
same line, delete "reciprocabIe" and insert ...reciprocable...

Column 8, line 1, delete "sald" and insert ...said...;
line 2, delete "chamher" and insert ...chamber...;
line 3, delete "pneumatic" (second instance);
line 38, delete "ste" and insert ...stem...

Signed and Sealed this

First Day of July 1986

[SEAL]

Attest:

DONALD J. QUIGG

Attesting Officer

Commissioner of Patents and Trademarks

UNITED STATES PATENT AND TRADEMARK OFFICE

CERTIFICATE OF CORRECTION

PATENT NO. : 4,566,371

DATED : January 28, 1986

INVENTOR(S) : Jorgensen, Ray B. and Robert T. Ackerman

It is certified that error appears in the above-identified patent and that said Letters Patent are hereby corrected as shown below:

Claim 2: column 7, line 1, cancel "tiles" and insert --tilts--.

Signed and Sealed this

*Twenty-third* Day of *September 1986*

[SEAL]

*Attest:*

DONALD J. QUIGG

*Attesting Officer*

*Commissioner of Patents and Trademarks*